US008794460B2

(12) United States Patent
Druitt et al.

(10) Patent No.: US 8,794,460 B2
(45) Date of Patent: Aug. 5, 2014

(54) HINGED CLOSURE FOR A CONTAINER NECK

(75) Inventors: Rodney Druitt, Cheltenham (GB); Louis Lagler, Stäfa (CH)

(73) Assignee: Creanova Universal Closures Ltd., Tewkesbury (GB)

( * ) Notice: Subject to any disclaimer, the term of this patent is extended or adjusted under 35 U.S.C. 154(b) by 1812 days.

(21) Appl. No.: 11/992,055

(22) PCT Filed: Sep. 15, 2006

(86) PCT No.: PCT/EP2006/066429

§ 371 (c)(1), (2), (4) Date: Sep. 9, 2009

(87) PCT Pub. No.: WO2007/031585

PCT Pub. Date: Mar. 22, 2007

(65) Prior Publication Data

US 2010/0005641 A1 Jan. 14, 2010

Related U.S. Application Data

(60) Provisional application No. 60/717,466, filed on Sep. 15, 2005.

(51) Int. Cl.
*B65D 41/00* (2006.01)

(52) U.S. Cl.
USPC ..... 215/235; 215/237; 215/306; 215/330; 220/298; 220/345.1; 220/345.2; 220/375; 222/544

(58) Field of Classification Search
USPC ..... 215/40, 43, 235, 237, 306, 316, 243, 215/329–331; 220/298, 837, 345.1–345.4, 220/375; 222/556, 541.1, 544
See application file for complete search history.

(56) References Cited

U.S. PATENT DOCUMENTS

| | | | | |
|---|---|---|---|---|
| 4,043,475 | A | 8/1977 | Wheeler | |
| 4,071,156 | A * | 1/1978 | Lowe | 215/224 |
| 4,567,992 | A | 2/1986 | Davis | |
| 4,919,286 | A * | 4/1990 | Agbay, Sr. | 215/235 |
| 5,067,624 | A * | 11/1991 | Thanisch | 215/235 |
| 5,148,912 | A * | 9/1992 | Nozawa | 220/838 |
| 5,335,802 | A | 8/1994 | Brach et al. | |
| 5,529,201 | A | 6/1996 | Tallent et al. | |
| 5,593,054 | A * | 1/1997 | Glynn | 215/225 |
| 5,605,240 | A * | 2/1997 | Guglielmini | 215/256 |
| 5,794,308 | A * | 8/1998 | Rentsch et al. | 220/4.22 |
| 5,938,054 | A * | 8/1999 | Loader | 215/206 |
| 5,984,123 | A * | 11/1999 | Mogami et al. | 215/235 |
| 6,041,477 | A * | 3/2000 | Rentsch et al. | 215/235 |
| 6,170,683 | B1 * | 1/2001 | Montgomery | 215/235 |

(Continued)

FOREIGN PATENT DOCUMENTS

| | | |
|---|---|---|
| CN | 1334773 A | 2/2002 |
| EP | 0 107 432 A2 | 5/1984 |

(Continued)

*Primary Examiner* — Mickey Yu
*Assistant Examiner* — Brijesh V. Patel
(74) *Attorney, Agent, or Firm* — Pauley Petersen & Erickson

(57) ABSTRACT

The invention is directed to a hinged closure (1) preferably molded in a closed position. The closure has a base (2) and a lid (3) interconnected to the base by a hinge arrangement (4). A latching mechanism (15) holds the closure (1) in position with respect to a neck (12) and prevents unwanted opening.

16 Claims, 6 Drawing Sheets

(56) References Cited

U.S. PATENT DOCUMENTS

| | | | | |
|---|---|---|---|---|
| 6,481,588 | B1 * | 11/2002 | Wagner | 215/235 |
| 6,926,162 | B1 * | 8/2005 | Culley | 215/252 |
| 7,051,888 | B2 * | 5/2006 | Antier et al. | 215/235 |
| 7,510,095 | B2 * | 3/2009 | Comeau et al. | 215/235 |
| 2002/0014467 | A1 * | 2/2002 | Reidenbach | 215/306 |
| 2002/0079282 | A1 * | 6/2002 | Harrold et al. | 215/237 |
| 2003/0192892 | A1 | 10/2003 | Fujita et al. | |
| 2004/0256347 | A1 | 12/2004 | Druitt et al. | |
| 2006/0163188 | A1 * | 7/2006 | Lagler | 215/235 |
| 2007/0284331 | A1 * | 12/2007 | Miota et al. | 215/320 |
| 2007/0284431 | A1 * | 12/2007 | Pan | 235/375 |
| 2008/0296251 | A1 * | 12/2008 | Johnston et al. | 215/330 |
| 2009/0236304 | A1 * | 9/2009 | Watson | 215/306 |
| 2011/0297682 | A1 * | 12/2011 | Kwon | 220/268 |

FOREIGN PATENT DOCUMENTS

| | | | |
|---|---|---|---|
| EP | 0 719 512 | A1 | 7/1996 |
| EP | 0 836 576 | B1 | 4/1998 |
| EP | 1 147 054 | A1 | 10/2001 |
| EP | 1 618 809 | A1 | 1/2006 |
| GB | 2 189 475 | A | 10/1987 |
| JP | 60-204466 | | 10/1985 |
| JP | 62-251353 | | 11/1987 |
| JP | 2-102368 | | 8/1990 |
| JP | 2002 370755 | A2 | 12/2002 |
| JP | 2003-312699 | | 11/2003 |
| JP | 2005-206187 | | 8/2005 |
| JP | 2007-505008 | | 3/2007 |
| WO | WO 9733800 | A1 * | 9/1997 |
| WO | WO 2005/007526 | A1 | 1/2005 |

* cited by examiner

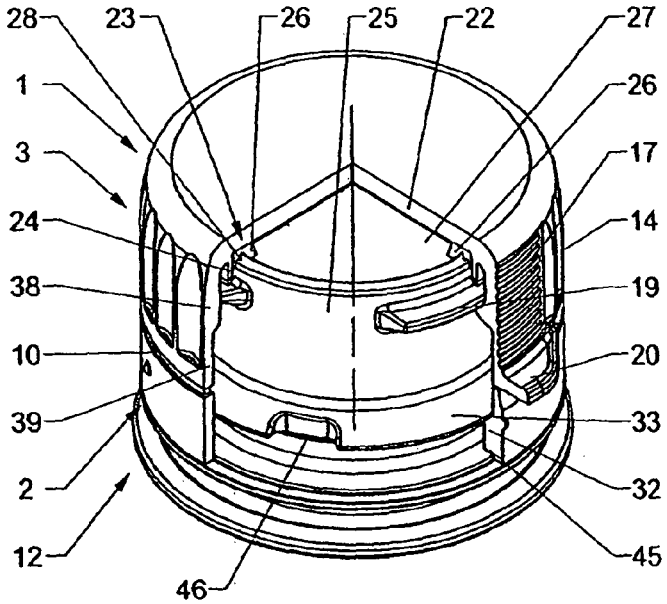
Fig. 14
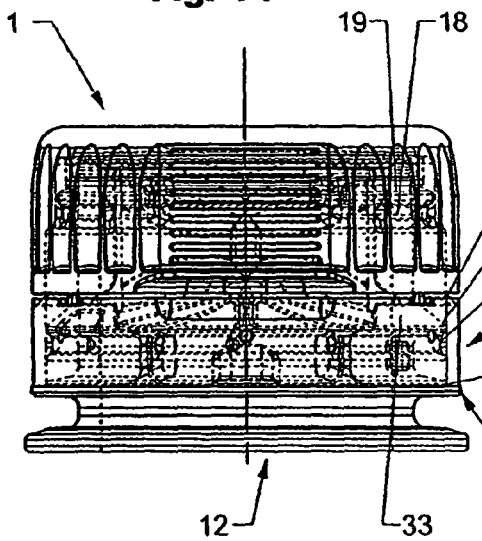
Fig. 15
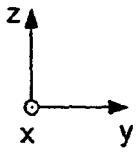
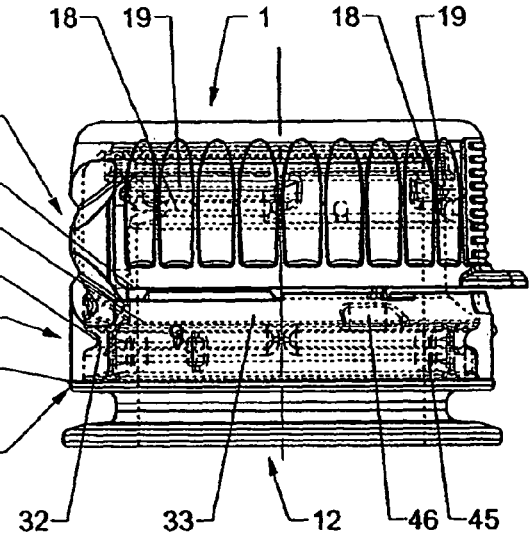
Fig. 16
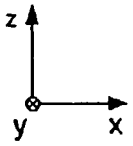

HINGED CLOSURE FOR A CONTAINER NECK

CROSS REFERENCE TO RELATED APPLICATIONS

International Patent Reference PCT/EP2006/066429, filed 15 Sep. 2006, claims a foreign priority benefit under Title 35, United States Code, Section 119. International Patent Reference PCT/EP2006/066429 claims priority to U.S. Provisional Application, Ser. No. 60/717,466, filed on 15 Sep. 2005. International Patent Reference PCT/EP2006/066429 and U.S. Provisional Application Ser. No. 60/717,466 are hereby incorporated by reference herein in their entireties and are made a part hereof, including but not limited to those portions which specifically appear hereinafter.

FIELD OF THE INVENTION

The present invention is directed to a hinged closure suitable to be applied on a neck of a container and a neck of a container suitable to be used with the hinged closure according to the preamble of the independent claims.

BACKGROUND OF THE INVENTION

WO2005/007526 is directed to a hinged closure molded in a closed position which is suitable to be used with carbonized beverages. The closure comprises a hinge and a latching mechanism which is suitable to securely lock the closure such that it prevents unwanted opening. A seal is arranged on the inside and is in closed position sealingly engaged with a neck of a container.

U.S. Pat. No. 5,335,802 describes a closure molded in a closed position. The closure consists of a tubular base portion and a cap, whereby in a closed position the outer contour of the cap is within the interior contour of the base portion. The cap and the base portion are connected to each other in a single unit by a snap hinge comprising a main hinge connection. Extending from the snap hinge, cap and base portion are additionally connected together by a safety strap for tamper evidence. The closure is not suitable for beverages, especially beverages under internal pressure. The closure requires relatively a lot of space due to the fact, that the side walls are arranged at an angle (inclined) with respect to the closure base. A further disadvantage consists in the main hinge connection between the closure body and the lid which results in a significant limitation of the freedom of movement. The open position of the lid normally is at a 90° with respect to the closed position. This opening angle is insufficient for beverage closures.

EP1147054 relates to a closed extruded plastic closure with a closure body and a lid which are interconnected to each other by a snap hinge. The snap hinge comprises no main hinge connection and thereby achieves a very large opening angle beyond 180°. Tamper evidence means are foreseen which serve as original warranty seal. If required an active element and a counter element serve as locking mechanism and prevent unintentional opening of the closure.

JP2002370755A2 is directed to a tube container capable of reducing the contents remaining in its neck. The tube container comprises a tube main body and a hinge cap molded in open position which is attached to the neck of the tube main body. The hinge cap is formed from a lid main body and an upper lid that are integrated via a hinge. The lower part of the hinge cap is attached to the tube neck via a bayonet-type of locking (bayonet mount). Four L-shaped grooves are formed in the peripheral edges of the neck which interact with four corresponding projections in the base of the hinge cap. To lock the base of the closure on the neck, the projections are inserted into the L-shaped grooves, and then the base of the hinge cap is locked by a turn. However, the lid of the closure is not locked and thereby can be opened and closed without limitation.

US2004256347 of the same inventor is directed to a closure that is suitable for attachment to a container. The closure comprises a top part with a skirt and a support ring that is engageable with the end portion of a container. The support ring is hingedly connected to the skirt. The closure further comprises an annular sealing rib with a first vertical portion and a second portion that is arranged at an angle with respect to the first vertical portion. The second portion is such that during attachment of the closure with the end portion of the container, the end portion of the container contacts the second portion of the sealing rib and pushes it upwardly and at least towards the first portion so as to form a seal between the end portion of the container and the closure. The closure is described as being suitable for carbonized beverages causing internal pressure. One problem consists in that the closure does not securely hold onto the neck it is applied to such that leakage can not be prevented. A further problem consists in that the lid can not be sufficiently opened due to the fact that the closure and the supporting ring are interconnected by a short hinge only which significantly limits the freedom of movement.

U.S. Pat. No. 5,529,201 is directed to a closure assembly for a filler neck having a mouth and an inner mounting flange coupled thereto. The closure for the mouth of the filler neck is provided with a body and an inner retainer fixed to the body. The inner retainer has a rigid portion and a cantilevered flexible portion. Rotation of the closure initially causes the rigid portion of the retainer to engage the flange so that the closure member is retained by the flange and continued rotation causes the cantilevered flexible portion to be deflected axially downward with respect to the axis of rotation of the closure. The closure is secured into the filler neck by a bayonet-type of locking device (bayonet mount).

EP1618809 is directed to a one piece secure cap which is mountable to a bottle neck, by a plurality of sets of mounting elements, one of which comprises a cam providing axial movement of the cap when it is rotated around the bottle, and a bayonet-type fixation. One mounting element is mounted on the interior of the cap and the other on the exterior of the bottle neck.

A bayonet mount or bayonet connector is a reversible fastening mechanism which was originally used for the fixation of a knife or a dagger-shaped weapon designed to fit on or over the muzzle of a rifle barrel or similar weapon. A bayonet connector in general relies on mated surfaces with a male side with one or more pins or slots and a female receptor with matching slots. To couple the two surfaces, users are expected to align the pins on the male with the slots on the female and push the two together. Once the pins reach the end of the slot, the two surfaces are turned in opposite directions to guide the pin into a perpendicular slot that prevents it from being removed.

Problem to be Solved

It is an object of the present invention to provide a hinged closure molded in closed position suitable to be used in connection with carbonized beverages. It is a further object of the present invention to provide a container, respectively a neck finish to be used in connection with a closure according to the present invention.

SUMMARY OF THE INVENTION

A closure according to the present invention in general comprises a ring-shaped lower part (body) and a cap-like upper part (lid) which is functionally interconnected by a hinge arrangement to the lower part. The lid of the closure in general incorporates at least one built-in first sealing device and/or at least one separate second sealing device made out of the same or a different material. The sealing device is designed to interact in a pressure-tight manner with a corresponding neck finish.

The lower and the upper part of the closure are interconnected to each other by a hinge structure. The hinge structure may be living, with snap effect, or dead, without snap effect. Direct connections by a single main hinge would be possible for certain applications although they are resulting in significant limitations e.g. with respect to the opening angle of the closure and its robustness. The closure parts may be connected directly or indirectly by further means such as locking means or means which are indicating tamper evidence or initial opening. If appropriate the closure is equipped with tamper evidence means, e.g. a tear-off band or frangible bridges, which are removed or destroyed during or prior to initial use, indicating first opening of the closure. If appropriate the closure may be covered by a removable thin foil of material e.g. shrinking-foil (shrink pack) to cover the package from external influences and/or to indicate initial opening.

The ring-shaped lower part of the closure (body, respectively base of the closure) in general comprises a first fastening means (holding means) which is suitable to fix the lower part of the closure on a neck, e.g. of a container, by cooperation with corresponding opposite fastening means, such as axially spaced apart beads, arranged at the neck. The upper part of the closure comprises second fastening means to detachably fix the upper part of the closure (lid) to the neck.

In an embodiment the second fastening means of the lid are of a bayonet-type. These bayonet-type second fastening means comprise first bayonet-segments protruding laterally inwardly suitable to interact in a closed position of the closure with corresponding second bayonet-segments arranged e.g. at a neck and protruding laterally outwardly. The first and the second bayonet segments are designed and arranged such that when the lid is moved with respect to the lower part on a path determined by the hinge the first and the second bayonet-segments mesh with each other in a first direction (direction of axis of rotation, respectively closure axis) when the lid is arranged above the neck. It is then possible to interlock the lid with respect to the neck by rotating at least the lid of the closure with respect to the neck by a certain angle around the closure axis (axis of rotation) such that the first and the second bayonet-segments securely mate with each other holding the closure in a closed position locked against relative axial movement. To avoid overturning of the closure stop elements may be foreseen, e.g. in that the bayonet-segments are designed such that they act as stop elements, and/or additional stop elements are arranged in the area between the lid and the neck. Such an arrangement may have the disadvantage that the bayonet-segments have a rather complicated design which might not be appropriate in certain fields of application. In an embodiment where the lid of the closure is at least in a closed position of the closure torsionally stiff interconnected to the base of the closure, alternatively or in addition stop elements preventing overturning of the closure may be foreseen in the area between the lower part of the closure (body) and the neck. This has the further advantage that the neck finish is more simple and in the mold design disadvantageous hindering undercuts can be avoided which results in a more simple mold design.

If appropriate the bayonet-segments can be designed/arranged such that by the rotation of the lid with respect to the neck, a seal in the lid is tightly pulled against the neck. This can e.g. be achieved in that the first and/or the second bayonet segments are arranged at least partially thread-like at an angle with respect to the circumferential direction or comprise a ramp. In an embodiment the bayonet-segments are arranged laterally spaced apart in circumferential direction at equal distances and at the same height (level) with respect to the closure axis (axis of rotation) or staggered at different levels. To improve the efficiency the bayonet segments may be arranged in several rows.

In an embodiment the lid and the body have in general a cylindrical design with a corresponding principle diameter. In such a closure a hinge as described in WO2005/007526 is advantageous due to several reasons. However, a closure according to the present invention is made such that it is capable to securely withstand vast internal pressure under large temperature ranges and external mechanical load.

A closure according to the present invention is normally manufactured with or without a sealing liner from several types of plastic, such as Polyethylene (from now on PE) or Polypropylene (from now on PP). The latter is used for the shell manufacture as shell material of liner closures; the material is harder and less durable than PE. Softer material such as Low density PE (LDPE), ethylene vinyl acetate (EVA), compounds based on polyolefinic raw materials or EVM-based materials such as Darex are often used as liner material. More rigid materials such as Polypropylene are often used as a shell material of hinged closures. If appropriate a barrier liner can be applied between the sealing liner and the and shell (lid) of the closure to prevent unwanted gas transmission. The barrier liner is made, preferably by injection molding, out of a barrier liner material such as polyvinylidene chloride (PVDC). PVDC has been known since a long time under the trade name Saran® for wrapping products in the form of resins and films. PVDC works by polymerizing vinylide chloride with monomers such as acrylic esters and unsaturated carboxyl groups, forming long chains of vinylide chloride. The copolymerization results in a film with molecules bound so tightly together that very little gas or water can get through. The result is a barrier against oxygen, moisture, chemicals and heat-qualities used to protect food, consumer and industrial products. PVDC is resistant to oxygen, water, acids, bases, and solvents. Alternatively or in addition the barrier liner may be made out of a biodegradable material such as a Plantic®. Depending on the field of application and the material used the barrier liner can be made by injection molding, or by compression molding or by co-extruding or by stamping out of a sheet of material.

The outer shell, the sealing means and the barrier liner of a closure according to the present invention are normally firmly bond to each other by a single injection molding process.

In an embodiment the barrier liner is arranged at least partially between the outer shell of the closure and the sealing means. However, depending on the field of application and the design of the closure, part of the barrier liner may be exposed to the goods (liquids) stored inside the container and/or the environment. The sealing means are normally arranged between the neck of the container and the outer shell of the closure, respectively the barrier liner, forming in a closed position a tight interconnection.

A two piece closure according to the present invention with or without a barrier liner is preferably made by an injection molding process, in particular a two-component, respectively a three-component injection molding process, in a single multi-component mold whereby a sealing liner with or without a downward leg (bore-seal and/or outside seal) is made in that a first plastic material is injected in liquid form into a first cavity onto a core of a mold cavity where the first material forming the sealing liner congeals. The sealing liner is thereby preferably shaped, respectively comprises holding means which guarantee that the sealing liner temporarily holds on a core such that the sealing liner can be moved with the core between several process steps. Good results have been achieved when the sealing liner has at least one downward leg which temporarily engages with the core but does not result in hindering retaining forces while demolding.

Afterwards, if applicable a barrier liner is applied at least onto a part of the back surface of the sealing liner, e.g. in that the sealing liner is moved into a second position, e.g. at an angle of 90° with respect to the first position at 0°, where a pre-made barrier liner is applied manually. Alternatively or in addition it is possible to provide a core in the mold which is displaced to form a cavity into which the material forming the barrier liner is injected. E.g. it is possible to design a back area of the cavity to form the sealing liner displaceable with respect to a front area such that a cavity for the barrier liner may be formed by moving the back area with respect to the front area by a certain distance which corresponds in general to the thickness of the barrier liner. The sealing liner thereby stays attached to either the front or the back area of the cavity. Alternatively or in addition it is possible to move the sealing liner arranged on a core from a 0° into a 90° position with respect to the first 0° position whereby in the 90° position the liner is enclosed into a cavity and then material forming the barrier liner is injected into the cavity. Depending on the design of the mold it is possible to inject at the same time, when the barrier liner is injected, material to form a further sealing liner in the cavity at 0° position. The barrier liner is preferably shaped such that it holds on the sealing liner without external aid. This can be achieved in that the barrier liner is shaped three-dimensional such that it cooperates at least partially with and holds onto the sealing liner during making of the closure, e.g. in that the barrier liner and/or the sealing liner comprise at least one protrusion which mates with a corresponding recesses in the sealing liner and/or the barrier liner. Alternatively or in addition the barrier liner can be shaped such that it temporarily holds onto the sealing liner due to vacuum. Depending on the field of application, a further possibility is to use a certain type of adhesive or glue.

In a further step the sealing liner and if present, the barrier liner are displaced with the first core into a third cavity position, e.g. a 180° with respect to the 0° position, wherein a further material component for an outer shell of the closure is injected into a further cavity forming at least a disc like top portion and an outer skirt of the closure. Normally, at least the material of the sealing-liner and the material of the outer shell are thereby integrally joined to each other.

To optimize the production process the area in the cavity of the sealing-liner which is not in contact with the first core is preferably shaped such that the sealing-liner can be taken out of the first cavity without unwanted retaining forces. Therefore hindering undercuts mainly extending perpendicularly with respect to the displacing direction of the core are avoided. By the described injection molding process a firm bonding may be obtained between the liner and the shell material.

The sealing liner may comprise means to position and align the barrier liner with respect to the sealing liner especially during the making of the closure. E.g. the sealing liner may comprise a down-ward leg which is arranged in general perpendicular with respect to the disk like top portion of the closure (in general concentric to the axis of the closure). This downward leg may comprise on the backside an annular cavity or a sequence of cavities arranged concentric to the downward leg which works as fastener means for the barrier liner which is provided as an element which is made by a separate external process or which is made by injection molding onto the sealing liner.

In an embodiment the sealing liner is at least partially bond to the outer shell of the closure such that the barrier liner is fully enclosed by the sealing liner and the outer shell of the closure. This offers the opportunity to choose a material for the barrier liner which does not necessarily bond to the materials of the outer shell and the sealing liner. A further advantage is that the closure different to closures known from prior art, does not tend to contaminate and it can easily be sterilized if necessary.

In a different embodiment the barrier liner may be designed to form an intermediate layer between the sealing liner and the outer shell of the closure. However thereby it is necessary that the materials for the sealing liner, the barrier liner and the outer shell bond to each other which reduces the selection of available materials.

When the sealing liner is made out of a transparent material it becomes possible to place information addressed to a customer in-between the sealing liner and the shell of the closure such that the information is visible from the inside of the closure or, when the shell of the lid is made out of a transparent material, from the outside. When a barrier liner made out of a non-transparent material is used it even comes possible to make different information available visible from the outside and from the inside, in that the information is e.g. printed on both sides of the barrier liner. The barrier liner can be printed outside the mold or information can be applied by in-mold labeling. In that the printed surfaces are fully encompassed by the sealing liner and the shell of the closure the danger of contamination is minimized.

To obtain a pressure tight closure which still seals at high internal pressure the sealing means may comprise a downward leg with an essentially cylindrical shaped inner skirt arranged inside the outer skirt of the closure shell extending perpendicular from the annular top surface into the closure radially distanced to the outer skirt and made out of the material of the outer shell of the closure and/or the liner. The inner skirt is at its base preferably interconnected directly to the disc like top portion of the closure. Depending on the field of application the leg shaped inner skirt may be functionally or rigidly interconnected to the outer skirt of the closure. However, this may implicate that the closure is not as flexible with respect to adjusting to a radial distortion of the neck of the bottle. Inside the inner skirt a sealing liner is arranged which is formed out of the same or a different material as the outer shell of the closure. The sealing liner is preferably made out of a softer material than the outer shell of the closure. Depending on the field of application, with respect to its cross-section the sealing-liner may comprise or be adjacent to an outer downward leg extending at least partially along the inner skirt of the outer shell. The outer downward leg of the liner or the inner skirt of the outer shell may comprise at its free end an in general toroidal sealing ring which interacts in closing position of the closure on the neck of a container radially from the outside with an in general cylindrical outer free surface, arranged between the annular top surface and the start of the outside thread of the neck of the container, via a designated contact surface. The contact surface is arranged preferably as far down onto the free surface of the neck of the bottle as possible to reduce influence of deformation, e.g. doming, bottle finish damage at the upper out-side rim, lifting of closure, of the closure which might occur. The toroidal sealing ring is preferably shaped such that it seals primarily due to annular tension. Therefore the toroidal sealing ring comprises an annular protrusion which is arranged in engaged position towards the neck of the container. In difference to seals known form prior art which act on the inside surface of the neck and therefore are mainly subject to annular pressure forces, the toroidal sealing of the present embodiment mainly seals due to annular tension forces. By the design of the sealing means contact and defined interaction with the outer skirt of the closure may be appropriate depending on the field of application although adjustability to radial distortion of the neck of a container is reduced.

The sealing-liner may further comprise a top seal which interacts with an annular top-surface of the neck of the container and/or a bore seal which reaches into the opening of the neck of the container. In difference to the prior art the present invention offers the opportunity to develop specific undercut regions aligned with respect to the neck of the container and forming contact zones of increased interaction between the sealing means and the neck of the container. One advantage of the herein disclosed sealing means consists in the improved performance of the sealing means when applied on damaged bottle neck finishes. Especially due to the reason that the described sealing means do interact with the neck finish in areas which normally are quiet unlikely to be damaged.

To optimize the mould utilization factor closures having a cylindrical or straight side wall are preferred. This aspect has to be considered in mould design, because closures having a cylindrical side wall often have undercuts which are difficult to demould. A mould cavity for a closure in general comprises a core defining the inner shape of a closure and at least two mould halves forming the outer shape of the closure. Further elements, such as stripping rings may be necessary to demould the closure or to remove the closure from the core.

To solve the above mentioned problems several molding related aspects have to be considered in the design of the closures. For technical and economical reasons it is foreseen that the hinged closure preferably can be stripped from the core. Good results are obtained by a stripping ring which is moved along the surface of the core of the mould which forms the inside of the closure. To prevent collision between the stripping ring and the hinge it is important that especially the hinge is designed in a way that it does not protrude over the main radius (diameter) of the core on the inside of the closure. The inside of the closure is preferably designed such that no feature radially protrudes above an inner principle side wall of the closure having a maximum inner diameter. Thereby it is achieved that the closure can be removed from a mold in a simple manner, e.g. by pushing from below and at the inside top wall, and the mold design as such becomes more simple. The hinge design is also subordinated to this philosophy i.e. the inside of the hinge arrangement is at least in the area of the film hinges designed in general flat. To obtain best hinge performance the film hinges should be designed straight.

Several sealing concepts to seal the orifice of the container are applicable depending on the field of application. Preferred sealing means are in general surrounding the upper rim of the neck of the orifice and/or are at least reaching partly into the orifice, working as a plug from the inside.

By contrast to conventional hinges, a herein foreseen hinge mechanism is preferably an improved coordinated multi axis hinge mechanism as described in EP0719512, EP0836576 and EP1075432, which does not have a main hinge connection between the closure parts. Thereby the restrictions, such as a weak snap effect, an insufficient opening angle or frangible hinges, inherent to the hinges known from the state of the art, may be overcome.

A closure according to the present invention is directed to an improved hinged closure molded in closed position, especially a hinged closure for pressurized beverages. The closure is provided with a latching mechanism offering the opportunity to lock the closure repeatedly even at high internal pressure. The closure may further comprise a tamper evidence means to prevent unforeseen and indicate initial opening.

In an embodiment a closure according to the present invention the latching mechanism is of the type of a bayonet coupling (bayonet fixation) which circumferentially evenly distributes the occurring internal and external forces between the lid of the closure and the neck finish and/or the base of the closure. The closure further comprises a hinge arrangement with a first and a second trapezoid element interconnecting the lid and the base of the closure via hinges. In an embodiment the lid of the closure comprises several first locking means protruding radially inwardly and laterally spaced a distance apart. In a further embodiment at least one locking means is arranged in the area of the hinge, e.g. in that the first locking means extends at least partially across a trapezoid element of the hinge. Still in a further embodiment locking means are arranged laterally adjacent or partially overlapping to a hinge connection suitable to interact in a closed position with corresponding locking means of a neck.

A neck of a container suitable to be used in connection with the closure comprises on the outside corresponding second locking means protruding radially outwardly and spaced apart such that they can be engaged with the first locking means of the closure. By rotating the closure with respect to the neck the first locking means of the closure may be engaged with the second locking means of the neck such that the lid of the closure is securely fastened onto the neck.

An sealing means in a closure according to the present invention preferably is made of different material than the rest of the closure. The sealing means comprises an in general P-shaped outer downward leg which in closed position is engaged with an outer free surface of the neck. In addition or alternatively the sealing means comprises an inner seal which acts onto the inside of the opening of the neck.

The invention is directed to a hinged closure molded in closed position with a base and a lid interconnected to the base by a hinge and wherein the lid comprises on the inside first locking means laterally spaced a distance apart and protruding radially inwardly suitable to be engaged with corresponding second locking means arranged on the outer surface of a neck of a container.

In an embodiment the first locking means are equally distanced with respect to each other. The lateral distance between the first locking means may be bigger than the lateral length of the second locking means, or they may overlap thread-like. If appropriate at least one first locking means is arranged in the area of the hinge securely holding the lid in this area. In case internal pressure is present it is preferable when during opening of the closure the frangible elements (bridges) break before the sealing means disengages or vice versa. Alternatively or in addition a tear-off band may be foreseen as a tamper evidence means. If appropriate cutting means may be foreseen, e.g. extending from the neck, which destroy the bridges before the sealing means disengages.

An embodiment of the invention is directed to a hinged closure, suitable to be engaged with a neck of a container or a bottle. The closure comprises a base and a lid interconnected to the base by a hinge arrangement. The lid comprises on the inside first locking means (bayonet segments) laterally spaced a distance apart and protruding radially inwardly suitable to be engaged in a closed position of the lid with corresponding second locking means (bayonet segments) arranged at the neck, e.g. an outside surface of the neck. The closure further comprises first stop elements suitable to be engaged with corresponding second stop elements arranged at the neck when the closure is applied onto the neck. The closure further comprises a seal to sealing close an orifice of the neck. The hinged closure is preferably molded in a closed position with the lid vertically arranged above and aligned with respect to the body. If appropriate at least one stop element is arranged at the base of the closure and the coordination of the lid with respect to the base is given by the hinge arrangement. If appropriate at least one first locking means is arranged in the area of the hinge arrangement extending at least partially across the hinge arrangement. Alternatively at least one of the first locking means is arranged adjacent to the hinge arrangement. In an embodiment the hinge arrangement comprises a first and second trapezoid element each interconnected to the lower part of the closure and the upper part of the closure by a film hinge. In that the trapezoid elements are designed sufficiently stiff, e.g. by the design of their cross-section, it is achieved that the during opening and closing of the closure the lid and the base of the closure rotate with respect to each other in a coordinated manner. A less coordinated movement with e.g. two or no step can be achieved in that the trapezoid elements are made torsionally week. If appropriate the trapezoid elements are interconnected to each other by a vertical film hinge. A neck suitable to be used in connection with a closure according to the present invention in general comprises second locking means suitable to be engaged with the first locking means arranged inside a lid and holding means suitable to be engaged with a base of a closure to firmly hold the base of the closure.

BRIEF DESCRIPTION OF THE DRAWINGS

The herein described invention will be more fully understood from the detailed description of the given herein below and the accompanying drawings which should not be considered limiting to the invention described in the appended claims.

FIG. 14 a partially cut closure arranged on a neck in a perspective view;

FIG. 15 a front view of a closure arranged on a neck in a transparent manner;

FIG. 16 the closure according to FIG. 15 in a side view;

DETAILED DESCRIPTION OF EMBODIMENTS

A better understanding of the present invention may be obtained by the present detailed description which, when examined in connection the accompanying drawings, sets forth embodiments of the inventions described herein. It should be understood that corresponding elements in the various figures are generally identified with corresponding reference numbers.

Figure 1:
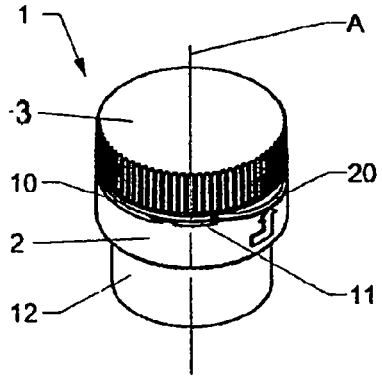
FIG. 1 a closure in a perspective view from the front.
Figure 2:
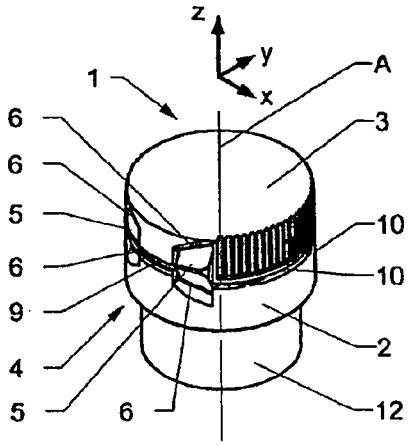
FIG. 2 is showing the closure according to FIG. 1 in a perspective view from the back.

FIG. 1 is showing a hinged closure 1 according to the present invention in a perspective front view and FIG. 2 is showing the closure 1 in a perspective back view on a container neck 12.

The closure 1 comprises a ring-shaped lower part 2 (body) and a cap-like upper part 3 (lid) which are interconnected by a snap hinge 4. The hinge of the shown embodiment does not have a main hinge connection between the body 2 and the lid 3. The snap hinge 4 comprises a first and a second trapezoid element 5, of which each is connected to the body 2 and the lid 3 by the hinges. The hinge elements 6 are embodied as film hinges comprising a thin web of material. The trapezoid elements 5 are here spaced apart separated by a cut-out 9. In certain embodiments the intermediate elements 5 may be connected to each other directly or indirectly by at least one additional film hinge (not visible in this embodiment). Such connection may result in a weaker hinge and/or delimiting of the opening angle. To obtain best hinge performance the film hinges should be designed straight.

The body 2 and the lid 3 are separated by a circumferential gap 10 in which tearable bridges 11 of plastic material are arranged. The bridges 11 are acting as tamper evidence elements which are destroyed while initial opening, indicating initial opening of the closure. Good results are obtained when the bridges are having a pyramidal shape.

The closure 1 is arranged on the neck 12 of a bottle which is only partially visible. The orifice of the bottle is arranged in the lid 3 (not visible), sealed off in closed position by a sealing mean. The body 2 is fixed on the neck 12 of the bottle, in general by press on. On the inside the body 2 does have holding means (not visible) which are suitable to be engaged with corresponding elements on the neck 12 of the bottle guarantying secure fixation of the closure 1. Axis A of the closure 1 is arranged parallel to z-axis of a global coordinate system. On the front of the closure 1 a finger recess 20 is visibly arranged at the upper rim of the lid 3.

Figure 3:
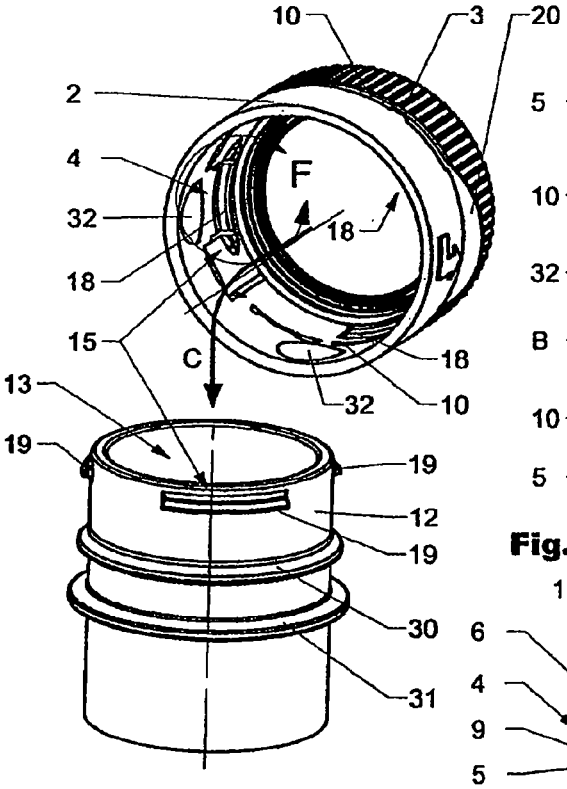
FIG. 3 is showing the closure according to FIG. 1 above a neck.

FIG. 3 is showing the closure 1 in a non-applied manner above the opening 13 of the neck 12 rotated with respect to the neck 12 by 90° such that the inside of the closure 1 is visible. The process of application is schematically indicated by the arrow C.

The lid 3 of the closure 1 comprises on the inside nearby to the circumferential gap 10 three first locking means 18 circumferentially evenly distributed protruding radially inwardly. In a closed and locked position, when the closure 1 is on the neck 12, the first locking means 18 are engaged with corresponding second locking means 19, arranged at the outside of the neck 12. The first and the second elements are preventing an unforeseen opening of the closure even at high internal pressure. The first and the second locking means 18, 19 are part of a bayonet-type latching mechanism 15 which prevents an unforeseen opening of the closure 1. In an intermediate position, when the first and the second locking means 18, 19 are not aligned, the lid 3 may be freely opened and closed, but in a closed position, when the first and the second locking means are aligned and engaged to each other, the lid is securely held onto the neck of the container and may not be opened.

Figure 4:
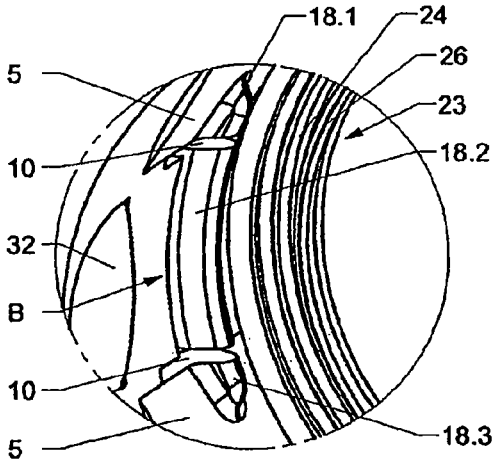
FIG. 4 is showing detail F of FIG. 3 in a magnified manner.

As it can be best seen in FIG. 4 which shows Detail F of FIG. 3, a first locking means 18 is arranged in the rear part of the lid 3, in the area of the hinge 4. It extends across the trapezoid elements 5 and the rear part of lid 3 (indicated by arrow B). To not obstruct the (upending) movement of the trapezoid elements 5 during the opening and closing of the closure 1 the first locking means 18 is by gap 10 segmented in the three parts 18.1, 18.2. 18.3.

Figure 5:
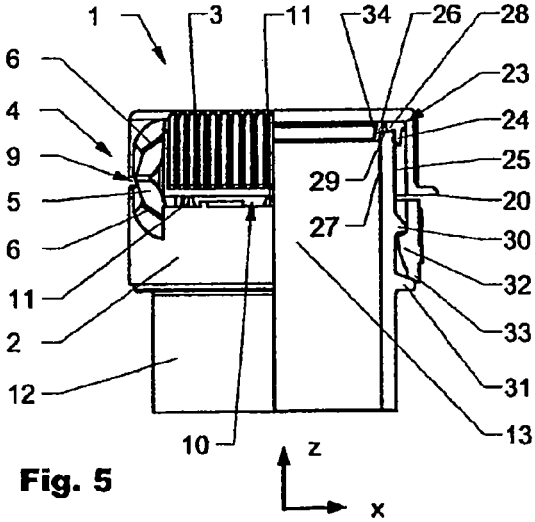
FIG. 5 is showing a closure applied onto a neck of a container.

FIG. 5 is showing the closure 1 applied onto the neck 12 in a side view. For better understanding the closure 1 and the neck 12 are displayed partially cut such that it is possible to view their inside.

The shown embodiment has a sealing element 23 which comprises an in general P-shaped outer downward leg 24 which is arranged inside of the lid 3. The outer downward leg 24 is in closed position engaged with an outer surface 25 of the neck 12. A here in general conically shaped inner downward leg 26 is engaged with an upper area of an inner surface 27 of the neck 12. A top seal 28 is engaged with an upper end surface 29 of the neck 12. The sealing means 23 of the shown embodiment of the closure 1 is made out of a sealing material, such as Darex, which is softer then the outer shell (such as body 2, lid 3 and hinge 4) of the closure 1 which is made out of a shell material such as Polypropylene (PP), Polyethylene (PE, HDPE). Thereby it is possible that sealing means 23 flexibly adjusts to the neck 12 of the closure 1. An inner pressure surface 34 of the inner downward leg 26 is arranged such that it is exposed to internal pressure P and pressed proportional to internal pressure P onto inner surface 27 and/or upper end surface 29. Thereby results an improved pressure proportional seal which in its functionality is supported by the top seal 28 and the outer seal 24.

As it can best be seen in FIGS. 4 and 5 the neck 12 comprises an upper and a lower holding rim 30, 31 protruding radially outwardly. In a mounted position, when the closure 1 is mounted onto the neck 12 (see FIG. 5), a lower end face 8 of the body 2 (lower part of the closure 1) is standing on the lower holding rim 31, and undercut segments 32, which are protruding radially inwardly from the inside of the body 2, are engaged with the upper holding rim 30, securely holding the closure 1 in position onto the neck.

The end position may be indicated by a stop element (not shown in detail). To open the lid 3 the closure 1 is rotated in the opposite direction until the first and the second locking means 18, 19 are not aligned with respect to each other. Then the lid 3 is lifted upwards in the area of the finger recess 20 until the bridges 11 break. The lid 3 is then further opened around the hinge 4 until the sealing means 23 disengages. The lid 3 finally comes to an end in an open position (not shown in detail).

Figure 6:
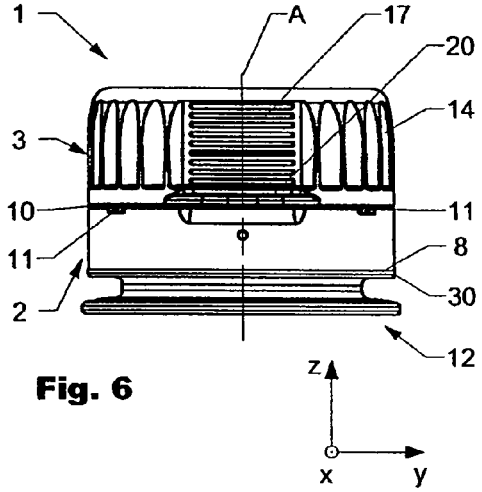
FIG. 6 a further embodiment of a closure applied on a neck in a front view.
Figure 7:
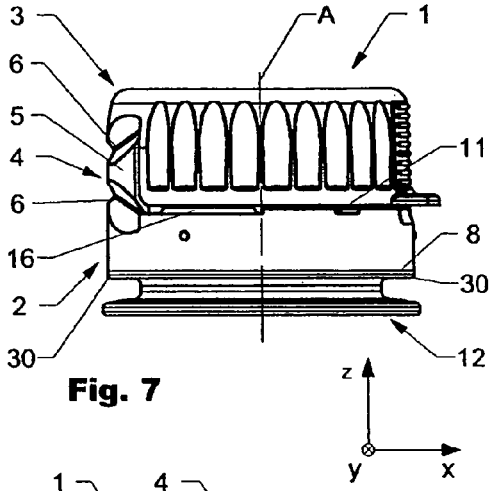
FIG. 7 the closure according to FIG. 6 in a side view.
Figure 8:
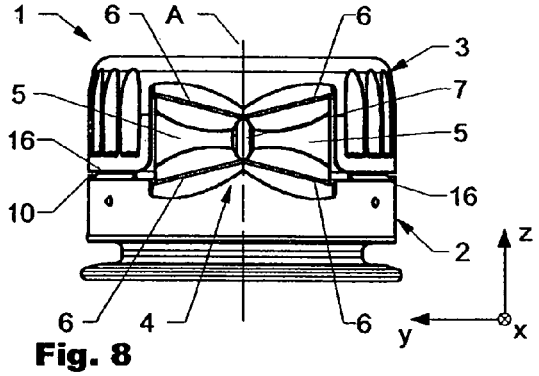
FIG. 8 the closure according to FIG. 6 in a rear view.
Figure 9:
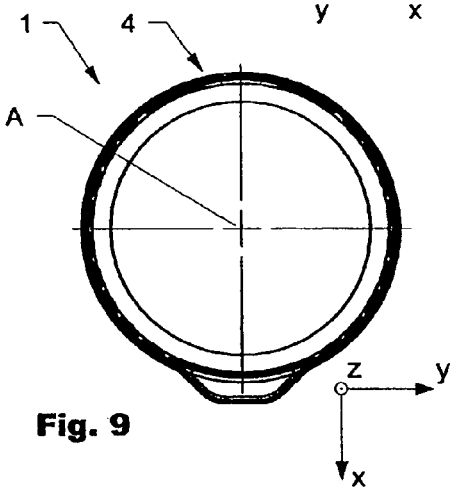
FIG. 9 the closure according to FIG. 6 in a top view.
Figure 10:
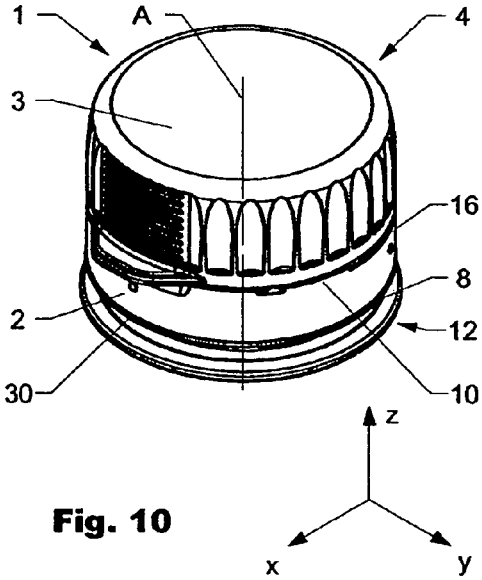
FIG. 10 the closure according to FIG. 6 in a perspective view from the front.
Figure 11:
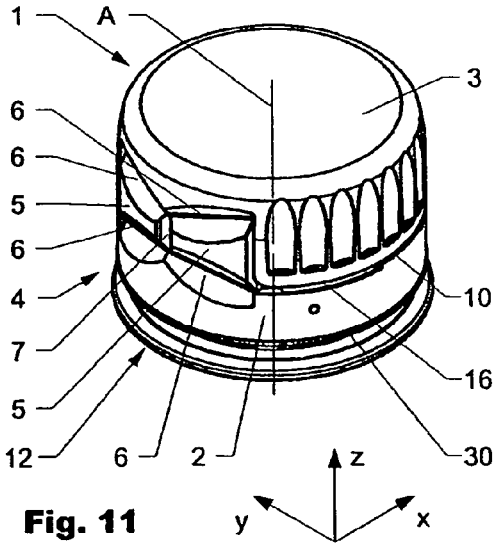
FIG. 11 the closure according to FIG. 6 in a perspective view from the back.

FIGS. 6 through 11 are showing different views of a further embodiment of a hinged closure 1 according to the present invention. FIG. 6 is showing the closure in a front view, FIG. 7 in a side view from the left side, FIG. 8 in a rear view, FIG. 9 in a top view, FIG. 10 in a first perspective view from the front and FIG. 11 in a second perspective view from the back.

The closure 1 comprises a ring-shaped lower part 2 (body) and a cap-like upper part 3 (lid) which are functionally interconnected to each other by a snap hinge 4 in a coordinated manner. The lower part 2 and the upper part 3 of this embodiment are shaped cylindrically having in principle the same outer diameter D. The hinge arrangement 4 is therefore arranged vertically (parallel to z-axis) resulting in a very space-saving floor plan (xy-plane) which is relevant to a cost-efficient layout of a mold for making the closure 1. On the front of the closure 1 a finger recess 20 is visibly arranged at the lid 3. At the outside the lid 3 comprises here the vertical knurls 14 which allow an easy gripping and indicate that the closure must be turned for opening. The circumferential knurls 17 at the front area of the lid 3 allow an easier lifting of the lid 3 for opening.

As it can be seen, the hinge arrangement of the shown embodiment does not comprise a main hinge connection between the body 2 and the lid 3. As a consequence thereof, the closure parts 2, 3 do not move on a circular path with respect to each other. The snap hinge 4 comprises a first and a second trapezoid element 5 of which each is connected to the body 2 and the lid 3 by two hinges 6 which are arranged recessed inside the outer contour of the closure 1. The hinge elements 6 are embodied as film hinges comprising a thin web of material. In this embodiment the trapezoid elements 5 are connected to each other by a vertical film hinge 7, which results in a stronger and torsionally stiffer hinge arrangement.

The body 2 and the lid 3 are separated by a circumferential gap 10 in which frangible elements, in form of the tearable bridges 11 and the thin webs of material 16, are arranged. The bridges 11 and the thin web of material 16 are acting as tamper evidence means which are destroyed while initial opening, indicating initial opening of the closure 1. While the herein pyramidal shaped tearable bridges 11 are in general arranged opposite to the hinge arrangement, the thin webs of material 16 are arranged adjacent on either side of the hinge arrangement. By the specific arrangement and design of the frangible elements 11, 16 it becomes possible to control the gas escapement while opening the closure.

The closure 1 is designed such that the injection mold (not shown) only requires two slides (not shown either) forming at least part of the outside. In an embodiment the slides would meet in the center of the closure along a vertical plane (yz-plane) and travel during opening and closing in x-direction.

As it can be seen, the closure 1 is arranged on a neck 12 partially covering the neck 12. A detailed description of the neck 12 and its design is given in the explanations of FIGS. 12 and 13. The orifice of the neck 12 is arranged inside the lid 3, sealed off in this closed position by a sealing means (see among others FIGS. 12, 13 and 14).

Figure 12:
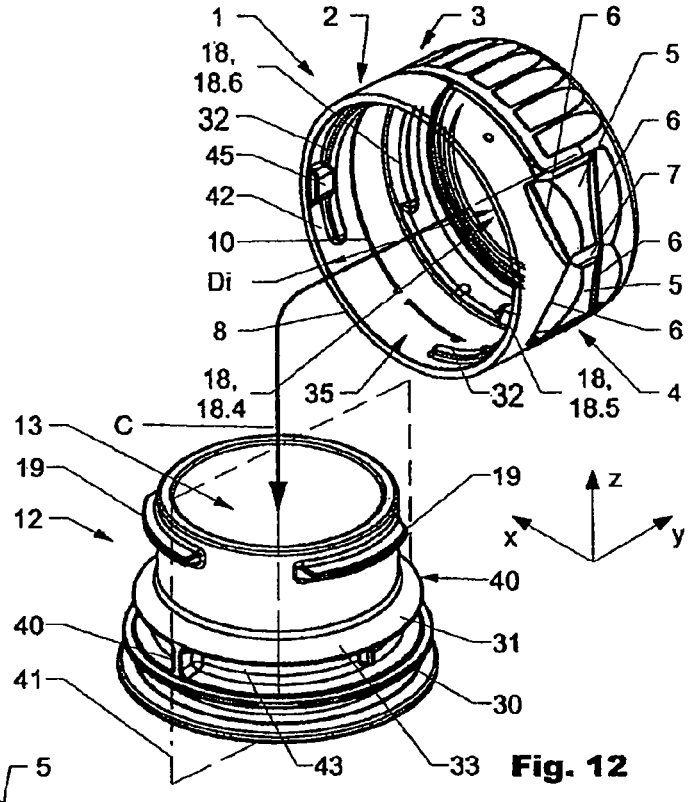
FIG. 12 a first perspective view of the closure according to FIG. 6 in a position above a neck.
Figure 13:
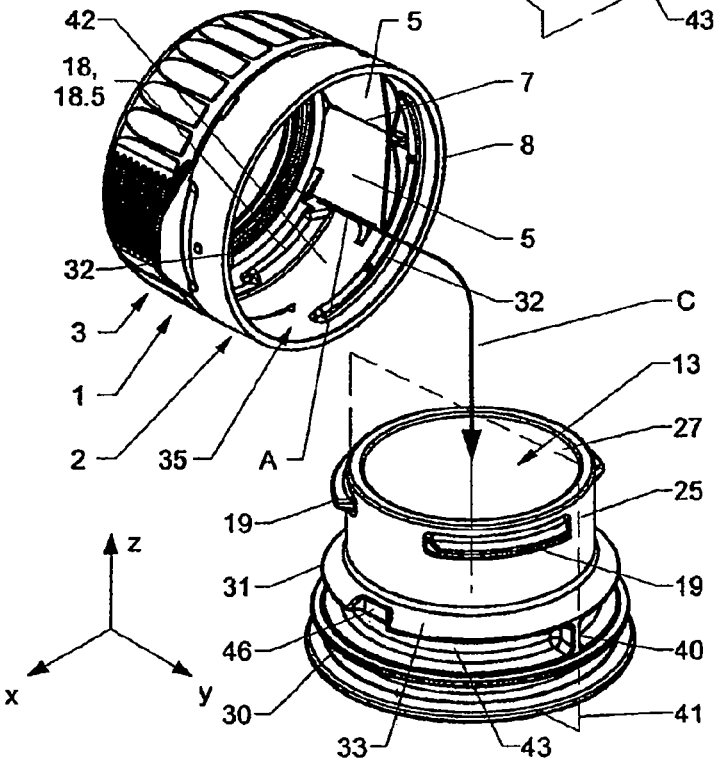
FIG. 13 a second perspective view of the closure according to FIG. 6 in a position above a neck.

FIGS. 12 and 13 are showing the closure 1 in a non-applied manner above an opening 13 of the neck 12 rotated with respect to the neck 12 by 90° such that the inside of the closure 1 is visible. The process of application is schematically indicated by the arrow C.

The body 2 of the closure 1 is fixed on the neck 12 of the bottle, in general by press on in vertical direction (indicated by arrow C) and is then held in position by a first and a second holding rim 30, 31 which interlock with the corresponding first and second undercut segments 32 arranged at the inside of the closure body 2 and spaced apart by a segment-free area 35 of a circumferential length which is chosen such that the closure 1 can be rotated with respect to the neck 12 by 60.degree., whereby the relative movement of the closure 1 in radial direction is delimited by two vertical ribs 40 arranged between the upper and the lower holding rim 30, 31. The ribs 40 which are in the shown embodiment, arranged opposite to each other at an angle of 180.degree., are acting as stop elements indicating the locked and the unlocked position of the lid 2, respectively the bayonet-segments 18, 19.

When the closure 1 is applied onto the neck 12 the base 2 of the closure 1 has to be circumferentially stretched such that undercut segments 32 can ride over the upper holding rim 31. Therefore, to simplify the application of the closure 1, the upper holding rim 31 comprises at its upper end a ramp 33 with an angle of approximately 30° to 50°. In-between the holding rims 30, 31 the in vertical direction delimiting surfaces are arranged here in general parallel to each other.

The lid 3 of the closure 1 comprises on its inside above the circumferential gap 10 three first bayonet-segments 18 (first locking means) in the shown embodiment circumferentially evenly distributed protruding radially inwardly. In a closed and locked position, when the closure 1 is on the neck 12, the first locking means 18 are engaged with corresponding second bayonet-segments 19 (locking means), arranged at the outside of the neck 12. The first and the second locking means 18, 19 are part of a bayonet type latching mechanism which prevents an unforeseen opening of the closure 1. In an intermediate position, when the first and second locking means are not aligned, the lid 3 may be freely opened and closed. But in a closed position, when the first and the second locking means 18, 19 are aligned and engaged with each other, the lid 3 is securely held onto the neck 12 and may not be opened.

In difference to the embodiment according to FIGS. 1 to 5, no first bayonet-segment is arranged across the inside of the hinge 4. Instead, the two first bayonet-segments 18.4, 18.5 are arranged adjacent to the hinge 4, and a third first bayonet-segment 18.6 is arranged in the front area of the lid of the closure 1, opposite to the hinge 4.

The first and the second bayonet segments 18, 19 are designed and arranged such that, when the lid 3 is moved with respect to the body of the closure 2 on a path determined by the hinge arrangement, the first and the second bayonet-segments 18, 19 mesh with each other in a first direction (z-axis) when the lid 3 is aligned above the neck 12. When the first and the second bayonet-segments are aligned with each other it is then possible to interlock the lid 3 on the neck 12 by rotating at least the lid 3 of the closure 1 with respect to the neck 12 by a certain angle, e.g. 60°, around the closure axis A such that the first and the second bayonet-segments 18, 19 securely mate behind each other, holding the lid 3 of the closure 1 in a closed position, locked against a relative axial movement in z-direction.

As described above, to avoid overturning and/or misalignment of the lid 3 with respect to the neck 12, especially in open and in closed position, the first and second stop elements 32, 40 are foreseen to interact with each other precisely defining the locked position, when the lid 3 can not be moved on a path defined by the hinge arrangement, and the unlocked position, when the lid 3 is ready to be moved on a path defined by the hinge arrangement. Although the stop elements could be arranged at the level of or integrated into the bayonet-segments 18, 19, the stop elements 32, 40 in the shown embodiment are arranged at the level of the lower part of the closure (body) 2. This has the advantage that the design of the bayonet-segment 18, 19 is less complicated and the bayonet-segments 18, 19, which carry most of the load, e.g. at high to internal pressure, can be made circumferentially longer such that they are capable of carrying more load. To improve the security, the number of stop elements can be increased accordingly, whereby it is important that they are properly spaced apart, corresponding to the bayonet segments 18, 19.

If appropriate, the bayonet-segments 18, 19 can be designed/arranged such that, by a rotation of the lid 3 with respect to the neck 12, the seal 26 in the lid 3 is tightly pulled against or controllably disengaged from the neck 12. This can e.g. be achieved in that the first and/or the second bayonet segments 18, 19 are arranged at least partially thread-like at a helix angle with respect to the circumferential direction or comprise a ramp, respectively a lead-in. If appropriate, the bayonet-segments 18, 19 are arranged laterally spaced apart in the circumferential direction at equal distances and at the same height (level) with respect to the closure axis A or staggered at different levels (z-direction). To improve the efficiency the bayonet segments 18, 19 may be arranged in several rows vertically spaced apart (z-direction).

The neck finish 12 of the herein described embodiment is designed such that it can be made in a very efficient way by an injection mold (not shown) having no additional sliders to demould undercuts. Therefore the bayonet-segments 19 of the neck 12 and the vertical ribs 40 aligned with respect to a mold separation plane schematically indicated by dashed line 41 which is arranged in general parallel to the yz-plane and runs through the middle of the orifice where the neck 12 has its maximal diameter.

The inside of the closure 1 is designed such that no feature radially protrudes above an inner principle side wall 42 of the closure 1 having a maximum inner diameter Di. Thereby it is achieved that the closure can be removed from a mold for making the closure 1 in a simple manner and the mold design as such becomes more simple. As it can be seen in FIG. 13 also the hinge design is subordinated to this philosophy, i.e. the inside of the hinge arrangement is at least in the area of the film hinges 6 designed in general flat. The closure 1 as shown is designed such that it can be applied by an existing machinery as available on the market. Thereby the closure is positioned above the neck 12 and then pressed vertically down (−z-direction) until it is engaged with the neck 12 as schematically indicated in FIGS. 12 and 13 by lines C.

During application of the closure 1 onto the neck 12, the closure 1 is preferably, when positioned above the neck 12, rotated around its axis A until the bayonet-segments 18, 19 of the closure 1 and the neck 12 are aligned with respect to each other before the closure 1 is pushed down and the undercut segments 32 engage with the upper holding rim 31. Thereby damage to the bayonet-segments 18, 19 may be reduced. If the number of bayonet-segments 18, 19 corresponds to the number of stop elements 32, 40 in general no additional feature is necessary to assure proper alignment because of the rotational symmetric set-up. However, due to the reason that in the shown embodiment the number of bayonet-segments does not correspond to the number of stop elements 32, 40, it is necessary to assure a proper alignment of the closure during the application. Therefore the closure 1 comprises an aligner 45 (see FIG. 12) arranged such that it aligns the closure 1 with respect to the neck 12 before the bayonet-segments 18, 19 or the stop elements 32, 40 engage with each other. As it can be seen in FIG. 13, the aligner 45 of the shown embodiment extends in vertical direction (z-direction) inside of the closure 1 along the inner principle side wall 42 between an undercut segment 32 and the lower end face 8 of the closure 1. The aligner 45 aligns the closure 1 with respect to the neck 12 in that it engages during application of the closure with a corresponding cutout 46 (see FIG. 13) in the upper holding rim 32, suitable to receive the aligner 45.

For applying the closure 1 is first brought above the neck 12 such that the closure 1 is horizontally aligned with respect to the neck 12. The closure 1 is moved in the direction of the neck 12 until the aligner 45 gets in contact with the ramp 33.

Then the closure 1 is rotated around its axis until the aligner 45 engages with the cutout 46 and the closure drops into a lower position with respect to the neck 12. When the aligner 45 is engaged with the cutout 46 also the bayonet-segments and the stop elements 32, 40 are in a proper position for the final application of the closure 1. In that the closure is pushed in the direction of the neck 1 the undercut segments 32 slide along the ramp 33 and the lower part 2 of the closure 1 is circumferentially stretched until the undercut segments 32 fall into the channel 43 between the upper and the lower holding rim 30, 31.

FIG. 14 is showing in a perspective view the closure 1 applied onto the neck 12. For better understanding the closure 1 is displayed partially cut such that it is possible to view the inside and the interaction between the closure 1 and the neck 12.

The shown embodiment comprises a first sealing means 23 with an in general P-shaped outer downward leg 24 which is arranged inside of the lid 3 extending perpendicularly from an inner end surface 22 of the lid 3. The outer downward leg 24 in closed position sealingly interacts with an outer surface 25 of the neck 12. The herein shown closure 1 further comprises a conically shaped inner downward leg 26 which is engaged with an upper area of an inner surface 27 of the neck 12. A third sealing means in form of a top seal 28 is engaged with an upper end surface 29 of the neck 12. The sealing means 23 of the shown embodiment of closure 1 is at least partially made out of a sealing material, such as Darex, which is softer then the outer shell (such as body 2, lid 3 and hinge 4) of the closure 1 which is made out of a shell material such as Polypropylene (PP), Polyethylene (PE, HDPE). Thereby it is possible that sealing means 23 flexibly adjusts to the neck 12 of the closure 1. An inner pressure surface 34 of the inner downward leg 26 is arranged such that it is exposed to the internal pressure P and pressed proportionally to the internal pressure P onto the inner surface 27 and/or the upper end surface 29. Thereby results an improved pressure proportional seal which is in its functionality supported by the top seal 28 and the outer seal 24. Depending on the field of application other seal configurations may be appropriate. As it can be seen, the closure has in an upper area 38 above the bayonet-segments a significantly higher wall thickness compared to a lower area 39 below the bayonet-segments 18. Thereby it is possible to withstand high internal pressure which occurs in the area of the sealing means 23, still keeping the closure 1 at a minimum weight possible.

FIGS. 15 and 16 are showing a closure 1 in an engaged manner with a neck 12 in a front view (FIG. 15) and in a side view (FIG. 16). Hidden lines are shown as dotted lines. When the closure 1 is mounted onto the neck 12 a lower end face 8 of the body 2 is standing on the lower holding rim 31 and the undercut segments 32 which are protruding radially inwardly from the inside of the body 2, are engaged with the upper holding rim 30, securely holding the closure 1 in position onto the neck. The closure 1 is shown on the neck 12 in a locked position when the bayonet-segments 18, 19 are engaged behind each other.

Figure 17:
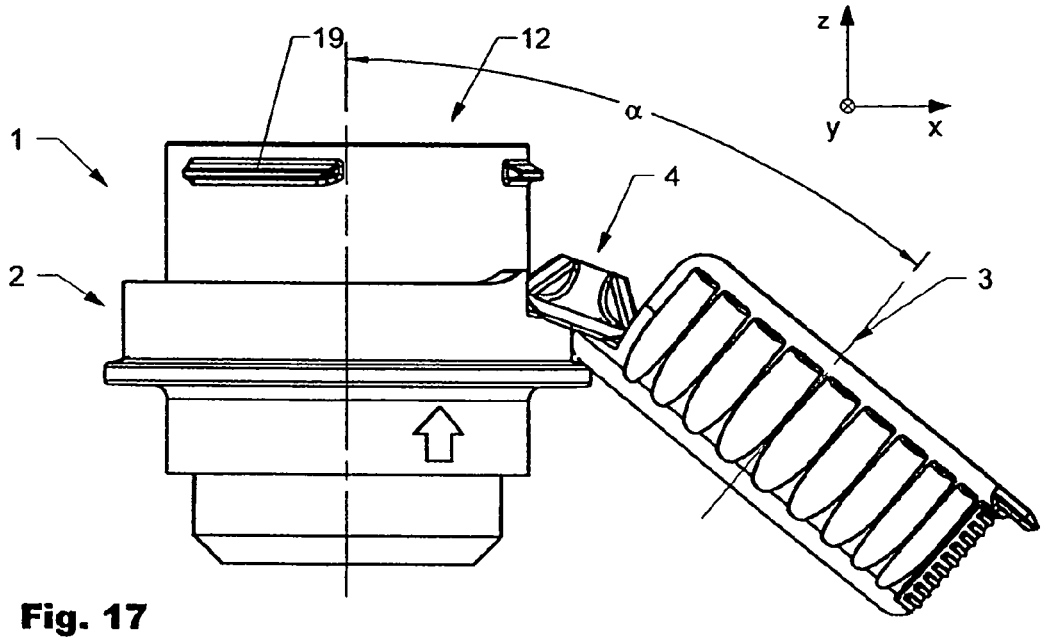
FIG. 17 a side view of a closure in an open position.
Figure 18:
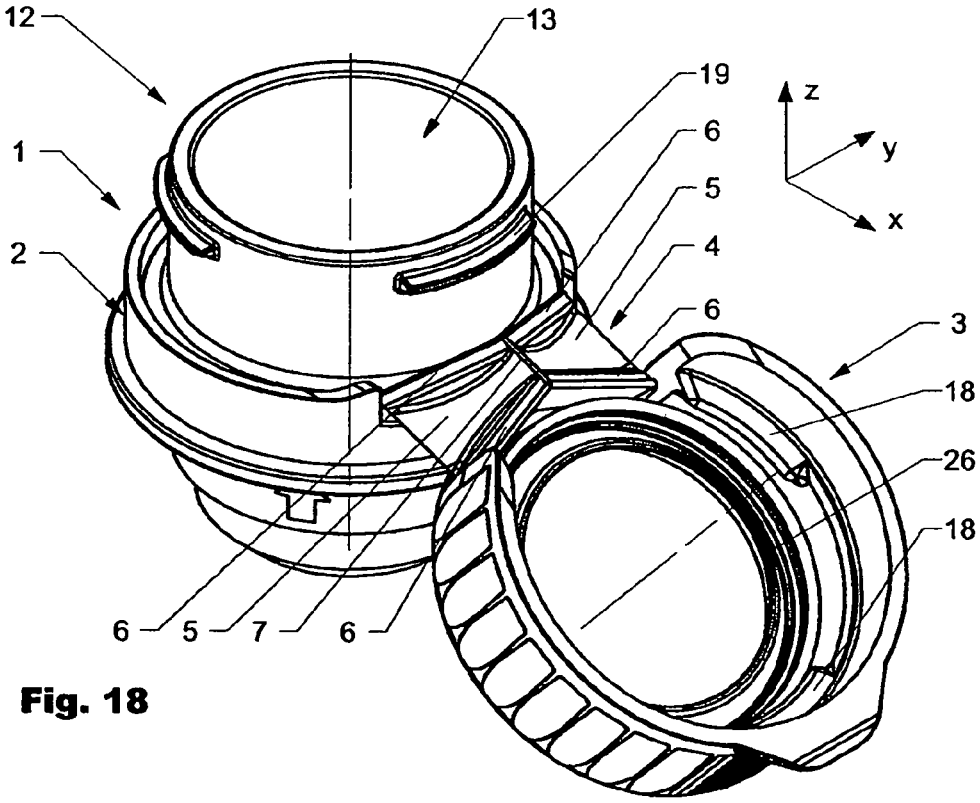
FIG. 18 a perspective view of the closure according to FIG. 17.

FIGS. 17 and 18 are showing the closure in an open position with the lid 3 arranged away from the orifice 13 of the neck 12. The opening angle $\alpha$, which is achievable by the hinge arrangement 4 as described, is beyond 180°. Thereby the lid 3 is not hindering the consummation of a good, exiting from the orifice. The neck 12 can be resealed by moving the lid 3 guided by the hinge 4 back into its original position above the base 2. In the open position the hinge arrangement 4 is in its second stable position. Thereby the hinges 6 and the vertical hinge 7 are bend into a reverse position. If the hinge arrangement would comprise a main hinge directly connecting the lid 3 and the base 2 no opening angles beyond 180° would be achievable.

Figure 19:
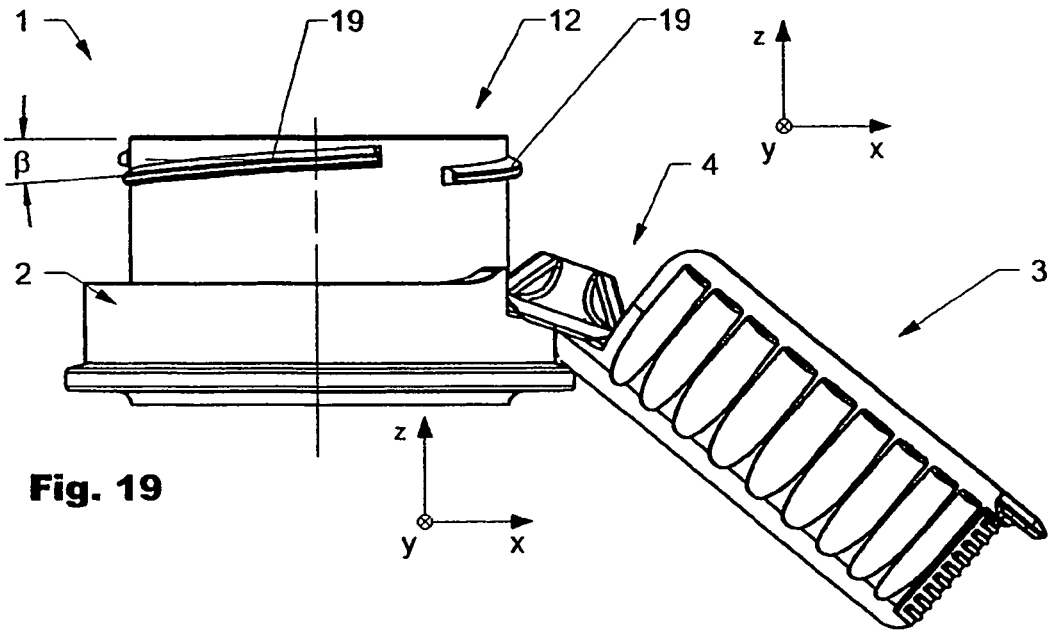
FIG. 19 a further embodiment of a closure in an open position in a side view.
Figure 20:
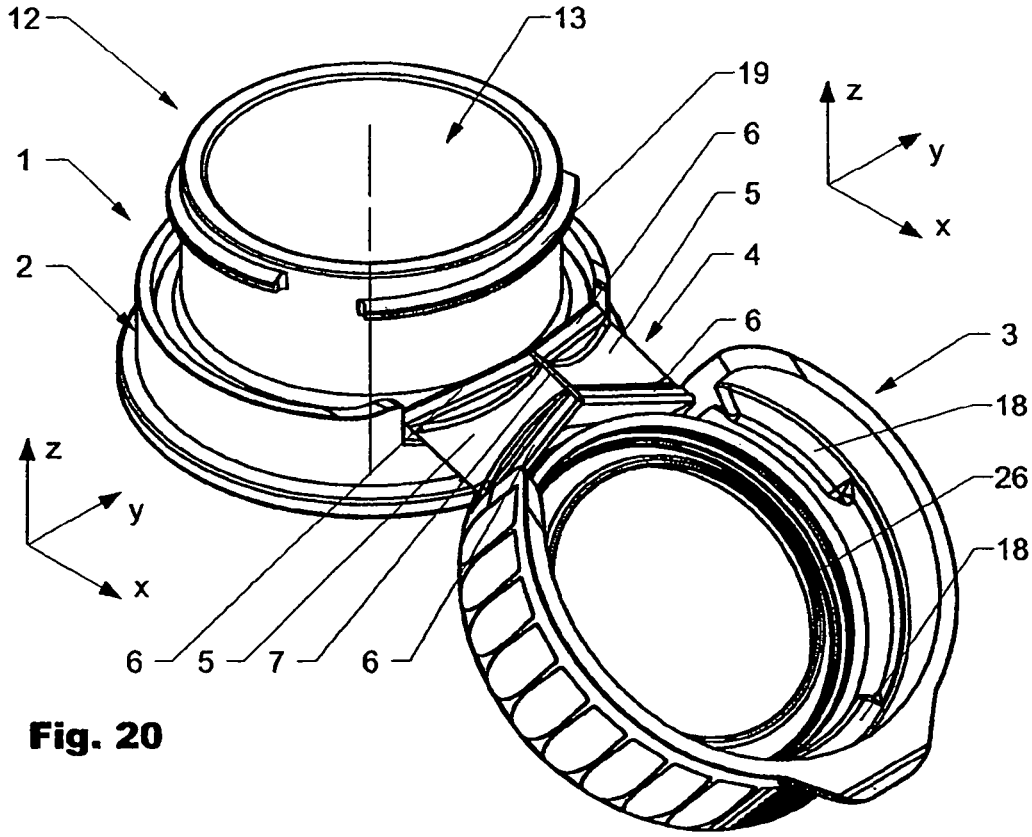
FIG. 20 a perspective view of the closure according to FIG. 19.

FIGS. 19 and 20 are showing a further embodiment of a closure 1 and a neck 12 in a side view (FIG. 19) and in a perspective view from the front (FIG. 20). The closure 1 and the neck 12 have in general a similar setup as described in accordance to the previous embodiments and will therefore not be described in full detail again. In difference to the previously described embodiments, the first and the second bayonet-segments 18, 19 are arrange at least along their interacting surfaces thread like at a helix angle $\beta$ with respect to the horizontal (xy-plane). The bayonet-segments 18, 19 and the hinge arrangement are designed and arranged such that the presence of the hinge arrangement causes no difficulty while opening and closing of the lid 3 of closure 1 due to limited tilting of the lid 3. This can e.g. be achieved in that during opening and closing of the lid 3 the bayonet segments 18, 19 are designed such that not all bayonet-segments 18, 19 are fully engaged/carrying.

A further difference which can be seen in this embodiment the second thread segments 19 arranged at the neck 12 have an extended circumferential length. The angled arrangement and if appropriate the extended length of the thread segments 19 may cause a decent venting during opening of the lid 3 of the closure 1.

The invention claimed is:

1. A hinged closure (1) for engaging with a neck (12), said hinged closure (1) comprising:

a base (2); and a lid (3) interconnected to the base (2) by a hinge arrangement, wherein the lid (3) comprises on the inside:

first locking means (18) laterally spaced a distance apart and protruding radially inwardly with respect to a closure axis (A), and adapted to engage in a closed position of the lid (3) with corresponding second locking means (19) arranged at the neck (12) and whereby the lid interlocks with respect to the neck (12) by rotating at least the lid (3) of the hinged closure (1) with respect to the neck (12) by a certain angle around the closure axis (A); and wherein the base (2) comprises on an inside:

first stop elements (32) adapted to be engaged with corresponding second stop elements (40) arranged at the neck (12) when the hinged closure (1) is applied onto the neck (12), said stop elements (32, 40) adapted to avoid overturning of the hinged closure (1) when rotating said lid around the closure axis (A), wherein a coordination movement between the lid (3) and the base (2) is transmitted by the hinge arrangement;

wherein the neck (12) includes holding means (30, 31) adapted to engage with the base (2) of the hinged closure (1), the holding means including a first holding rim (30) and a second holding rim (31), spaced a distance apart by a channel (43), wherein the second stop elements (40) extend into the channel and the first stop elements (32) are adapted to engage and move within the channel (43).

2. The hinged closure (1) according to claim 1 wherein the hinged closure (1) is molded in a closed position with the lid (3), vertically (z) arranged above and aligned with respect to the base (2).

3. The hinged closure (I) according to claim 1 wherein the first locking means (18) are equally distanced with respect to each other.

4. The hinged closure (1) according to claim 1 wherein a lateral distance between the first locking means (18) is bigger than a lateral length of the second locking means (19).

5. The hinged closure (1) according to claim 1 wherein at least one first locking means (18) is arranged in an area of the hinge arrangement and extends at least partially across the hinge arrangement.

6. The hinged closure (1) according to claim 1 wherein at least one of the first locking means (18) is arranged adjacent to the hinge arrangement.

7. The hinged closure (1) according to claim 1 wherein the hinge arrangement comprises:

a first trapezoid element (5) and a second trapezoid element (5), each interconnected to a lower part of the hinged closure (1) and an upper part of the hinged closure (1) by a film hinge (6).

8. The hinged closure (1) according to claim 7, wherein the first trapezoid element (5) and the second trapezoid element (5) are designed such that the during opening and closing of the hinged closure, the lid (3) and the base (2) of the hinged closure (1) rotate with respect to each other in a coordinated manner.

9. The hinged closure (1) according to claim 7, wherein the first trapezoid element (5) and the second trapezoid element (5) are designed such that the during opening and closing of the hinged closure the lid (3) and the base (2) of the hinged closure (1) rotate with respect to each other in a non-coordinated manner.

10. The hinged closure (1) according to claim 7 wherein the first trapezoid element (5) and the second trapezoid element (5) are interconnected by a vertical film hinge (7).

11. The hinged closure (1) according to claim 1 wherein the base (2) and the lid (3) of the hinged closure (1) are delimited by a circumferential gap (10).

12. The hinged closure (1) according to claim 1 further comprising:

frangible elements (11, 16) arranged between the lid (3) and the base (2) which are destroyed during an initial opening of the hinged closure (1).

13. The hinged closure (1) according to claim 1 wherein a number of locking means (18, 19) is different to a number of stop elements (32, 40).

14. The hinged closure (1) according to claim 1 wherein an interacting surface of the locking means (18, 19) are at least partially arranged at a helix angle β.

15. A method for opening of a hinged closure (1) of claim 1, the method comprising the following steps:

a) aligning the first locking means (18) protruding radially inwardly in-between the second locking means (19) arranged at the neck (12) protruding radially outwardly, by rotating the hinged closure (1) around its axis (A) aligned to the axis (z) of the neck (12);

b) lifting the lid (3) until a sealing means (26) and the first locking means (18) and the second locking means (19) are disengaged;

c) moving the lid (3) away from an orifice (13) of the neck (12) in a manner coordinated by the hinge arrangement.

16. The method according to claim 15, wherein the lid (3) is moved on a non-circular path with respect to the base (2).

* * * * *